United States Patent [19]

Krauss et al.

[11] 4,136,977

[45] Jan. 30, 1979

[54] MOUNT FOR A CONSUMABLE ELECTRODE MATRIX PRINTER

[75] Inventors: Otto Krauss, Stein-Deutenbach; Josef Lendl, Ottensoos, both of Fed. Rep. of Germany

[73] Assignee: Triumph Werke Nurnberg A.G., Nurnberg, Fed. Rep. of Germany

[21] Appl. No.: 834,980

[22] Filed: Sep. 20, 1977

[30] Foreign Application Priority Data

Oct. 16, 1976 [DE] Fed. Rep. of Germany ..... 2646783

[51] Int. Cl.[2] ..... B41J 3/20

[52] U.S. Cl. ..... 400/120; 346/139 C; 346/162

[58] Field of Search ..... 197/1 R; 219/216; 346/76 R, 139 C, 162; 400/119, 120, 121, 124

[56] References Cited

U.S. PATENT DOCUMENTS

| | | | |
|---|---|---|---|
| 3,291,276 | 12/1966 | Milne et al. | 346/139 C X |
| 3,300,017 | 1/1967 | Yazejian et al. | 197/1 R |
| 3,541,579 | 11/1970 | Von Hippel | 346/139 C |
| 3,846,802 | 11/1974 | Kyotani et al. | 346/139 C X |

*Primary Examiner*—Paul T. Sewell

*Attorney, Agent, or Firm*—Brian L. Ribando

[57] ABSTRACT

A mount for a consumable electrode printer comprises a member which slidably receives an array of consumable electrodes which are biased to a printing position, a clamp for gripping the electrodes to prevent the sliding thereof, and a release for the clamp to allow the biased electrodes to advance to a printing position.

5 Claims, 3 Drawing Figures

Fig_1
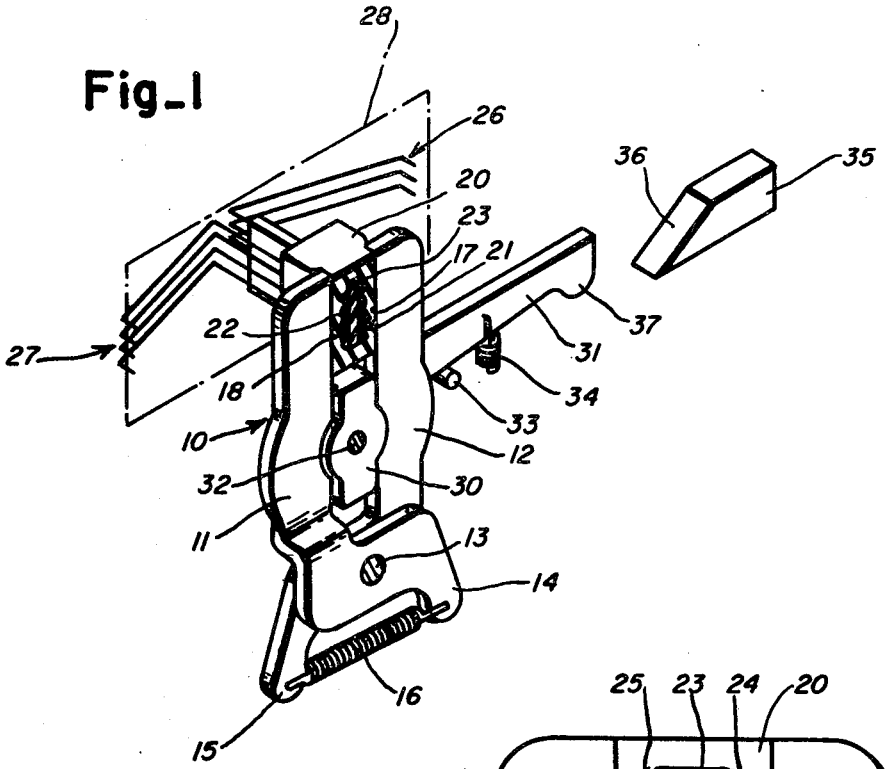
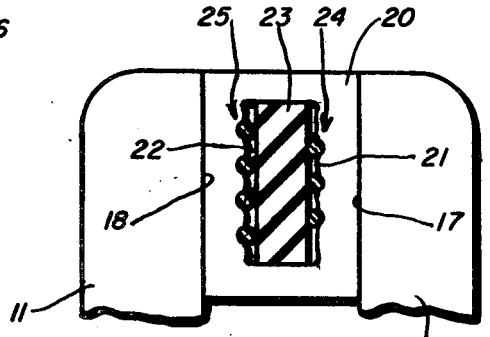
Fig_3
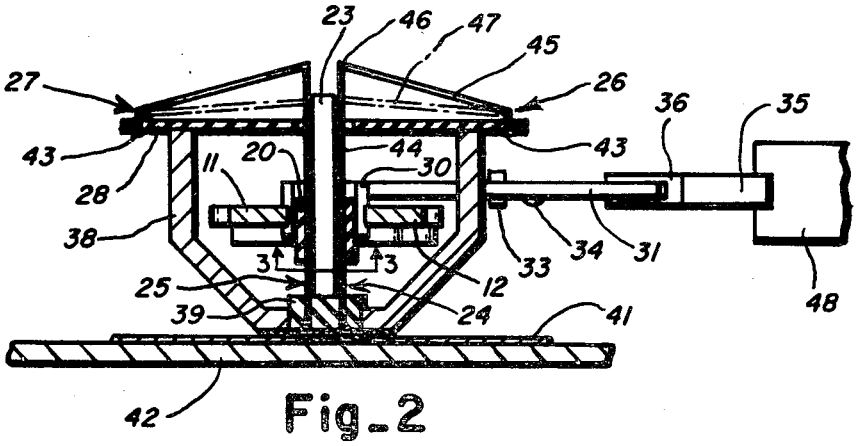
Fig_2

MOUNT FOR A CONSUMABLE ELECTRODE MATRIX PRINTER

BACKGROUND OF THE INVENTION

The invention relates to a matrix printer, and more particularly to a matrix printer having electrodes which are biased for advancement toward a platen, and specifically to a clamp for releasably gripping the electrodes.

Matrix printers having electrodes which are in riding contact with a record carrier or with an ink carrier are known in the prior art. The electrodes produce characters on the record carrier either through the effects of heat, or through the effects of a voltage discharge. Because the electrodes are consumed and worn during their use, they must be periodically repositioned relative to the medium on which they are printing in order to remain effective.

One arrangement for repositioning such electrodes is shown by German Pat. No. 1,266,030 in which an electrode array is moved relative to a record carrier and wherein the electrode array is resiliently biased into conact with the carrier. Because of the geometry of the electrodes, printing can occur in one direction only.

SUMMARY OF THE INVENTION

In accordance with the present invention, a mount is provided for an array of electrodes which comprise a matrix printer. One end of each of the electrodes pass through a channel which is formed in a resilient member. The electrode ends are maintained separate from one another by passing through individual apertures in a perforated plate. Opposite ends of each of the electrodes are fastened to an insulating plate in a way such that the resilience of the electrodes and a prestressing thereof causes the electrodes to bias themselves toward a platen. The resilient member is normally engaged by a spring loaded clamp and the force exerted by the clamp against the member fixes the electrodes within the channel and prevents movement of the electrodes therein.

A rotatable spreader is positioned between the legs of the clamp and is controlled by a spreader arm. The spreader arm is periodically engaged by a camming surface causing the spreader to act against the legs of the clamp and to release the grip of the clamp on the resilient member. This release of the clamp grip allows the biased electrodes to be urged in the direction of the platen. This periodic motion of the electrodes toward the platen compensates for wear and/or consumption of the electrodes caused by the printing process.

An object of the invention is to provide a mounting assembly for the electrodes of a matrix printer which automatically compensates for electrode wear.

Another object of the invention is to provide a mounting assembly for the electrodes of a matrix printer in which biasing means urge the electrodes to a platen and in which means are provided to clamp the electrodes in a printing position and to prevent the movement thereof.

A further object of the invention is to provide a mounting assembly for the electrodes of a matrix printer in which biasing means urge the electrodes to a platen, a clamp secures the electrodes in a printing position, and means are provided to periodically release the clamp to allow a repositioning of the electrodes.

These and other objects of the invention will become apparent from the following detailed description taken in connection with the accompanying drawing figures in which like reference numerals designate like or corresponding parts throughout the figures.

BRIEF DESCRIPTION OF THE DRAWING

FIG. 1 is a perspective view of a mount assembly for a consumable electrode matrix printer;

FIG. 2 is a top sectional view showing an electrode mount within a housing; and

FIG. 3 is a sectional view taken along line 3—3 of FIG. 2.

DESCRIPTION OF THE PREFERRED EMBODIMENT

Referring now to the drawings, there is shown in FIGS. 1 and 3 a clamp generally designated by reference numeral 10. The clamp 10 comprises a pair of jaws 11 and 12 which are pivoted to one another by a pivot pin 13. The jaws 11 and 12 include end portions 14 and 15, respectively, which portions are connected together by a tension spring 16. The ends of the jaws which are opposite the end portions 14 and 15 form clamping surfaces 17 and 18. The clamping surfaces 17 and 18 engage opposite side surfaces of a resilient member 20. The member 20 is formed with a central through passage located therein and the interposition of an insulating stem 23 divides the passage into two channels 21 and 22. Positioned within the channels 21 and 22 are the individual electrodes of electrode arrays 24 and 25. The arrays 24 and 25 are prevented from contacting one another by the insulating stem 23. Each of the electrodes in the array 24 and each of the electrodes in the array 25 are prevented from contacting one another by their respective positions within the channels 21 and 22. Each electrode is obliquely bent and terminates in an attachment end. Shown in phantom at 28 is an insulating plate to which attachment end arrays 26 and 27 are fixed.

It will be appreciated that the tension spring 16 causes a force to be exerted by the clamping surfaces 17 and 18 of the clamp 10 on the resilient member 20. This force is sufficient to cause the member 20 to be deformed such that the individual electrodes are clamped in an immovable position in their respective channels 21 and 22. As can best be seen in FIG. 3, the resilient material of member 20 conforms to the shape of the electrodes forming a trough for each.

Located between the jaws 11 and 12 is a spreader member 30. This member is rigidly attached to a spreader arm 31, and this arm together with the spreader member is pivotably mounted on a pin 32. The arm 31 rests on a stop pin 33 and is biased downward by a tension spring 34. A fixed cam 35 is provided and includes a sloped camming surface 36. This cam and camming surface are so located such that movement of the electrode mounting assembly toward the cam 35 results in a lobe 37 which is formed on the end of the spreader arm 31 to engage the camming surface 36. This engagement causes the spreader arm 31 and the attached member 30 to pivot about the pin 32. This pivoting rotates the spreader member 30 against the adjacent surfaces of the jaws 11 and 12 causing these jaws to separate.

Turning now to FIG. 2, the resilient member 20 and the clamping surfaces of the clamp 10 are shown disposed within a housing 38. This housing includes a perforated plate 39 through which the electrodes of the electrode arrays pass. It will be appreciated that the individual electrodes are guided and are maintained in proper orientation with respect to one another by the ordered perforations in the plate 39. A record carrier 41 is positioned adjacent the ends of the electrodes of the electrode arrays 24 and 25. The record carrier is supported by a backing surface or platen 42. The ends of the individual electrodes which are remote from the record carrier 41 pass through the insulating plate 28 and terminate in attachment points 43. The attachment points 43 are rigidly fixed to the insulating plate 28. It is contemplated that a material such as tungsten, having both the desired electrical conducting properties and mechanical resilience properties, may be suitably employed for the electrodes. Each electrode comprises two portions, a first portion 44 which is parallel to and adjacent the insulating stem 23 and a second portion 45 which is disposed at an angle thereto. A bend 46 in the electrode material defines the juncture of the two portions 44 and 45. The mounting of the portion 45 to the plate 28 in the region of the attachment point 43 is such that the portion 45 is closely adjacent the plate 28 as shown in phantom at 47. This orientation causes the end portion of the electrode which is remote from the attachment point 43 to protrude from the front surface of the perforated plate 39. In order to prepare the mounting assembly for use in a printing machine, the electrode portion 44 must be withdrawn into the housing 38 to allow the portion 44, which protrudes from the perforated plate 39, to clear the platen 42 and the record carrier 41. The withdrawing causes the portion 45 to deflect from the unstressed position 47 to the biased position as shown. It will be appreciated that in this position, the rigid mounting of the portion 45 to the plate 28 at 43 causes the portion 44 to be urged to the platen 42 by the resilience of the electrode material in the electrode portion 45.

Further in the Figure, it will be seen that the spreader arm 31 extends beyond the confines of the housing 38. The lobe 37 formed on the end of the spreader arm 31 is shown in engagement with the camming surface 36. The camming surface is fixed to a support 47 which may be a margin stop or a frame member.

The operation of the device should be apparent to those skilled in the art. During the printing operation, the housing containing the electrode array together with the resilient member 20 and the clamp 10 is made to traverse a record carrier. At the end of such traverse, the housing is recycled back to a start of line position. Upon reaching the start of line position, the lobe 37 engages the camming surface causing the spreader arm to pivot about its mounting pin and the spreader member to separate the jaws of the clamp. This separation releases the pinching forces which holds the individual electrode members in a fixed position within the channels 21 and 22. The resilience of the individual electrodes causes each electrode portions 44 to be biased in a forward direction. Where the printing operation has resulted in a consumption or eroding away of the printing ends of the electrodes, the electrode, because of its forward biasing, will be automatically repositioned relative to the record carrier for further printing operations. Before the next line of printing is begun, the housing moves from the start of line position and the lobe of the spreader arm is withdrawn from the camming surface. This rotates the spreader member in a manner which allows the jaws of the clamp to resume a gripping engagement with the resilient member. This engagement fixes the individual electrodes within the electrode channels in a proper position for printing.

Various modifications of the disclosed device will occur to those skilled in the art. For instance, the cam may be located so as to engage the lobe of the spreader arm when the electrode array together with the clamp is at the end rather than at the beginning of a printing line. In an application where the printing electrodes and the mounting means therefor are in a fixed position and the record carrier is moved relative thereto, means such as a moveable cam located on the record carrier may be provided to engage the lobe of the spreader arm in order to release the grip of the clamp on the resilient member. Such means may be mechanical or electromechanical in nature. Also, while the backing surface or platen has been shown as a planar surface, this surface may be curved without other modifications to the apparatus described being necessary.

A modification of the invention may comprise an electrode array having only one vertical row of electrodes, obviating the need for the central insulating stem. Also, the resilient member may be omitted and the electrodes may be contacted directly by the clamping surfaces of the clamp 10. If desired, the clamping surfaces may be provided with a resilient coating. Further, materials other than tungsten may be used in forming the individual electrodes of the electrode arrays.

We claim:

1. In combination in a mount for a consumable electrode printer, at least one consumable electrode, first means comprising a resilient member for slidably receiving said consumable electrode, biasing means for said consumable electrode, clamp means engaging opposite sides of said resilient member for gripping said electrode to prevent the sliding thereof, and second means for relaxing said gripping means whereby said biasing means advances said electrode to a printing position.

2. The apparatus of claim 1, said clamp comprising a pair of jaws, a pivot securing said jaws one to the other, and resilient biasing means for biasing said clamp to grip said resilient member, and further including a jaw spreader member and means for causing said spreader member to spread apart the jaws of said clamp.

3. The apparatus of claim 2 further comprising a first array of electrodes, a second array of electrodes, means for isolating said first array from said second array, a housing, passages in said housing for passage of said electrode arrays therethrough, and attachment means for attaching one end of each of said electrodes to said housing.

4. The apparatus of claim 3, said means for causing the spreader member to spread apart the jaws of the clamp comprising a spreader arm, a camming surface, and means for engaging said spreader arm with said camming surface, whereby said spreader rotates against said jaws to release the clamp from said resilient mount.

5. The method of adjusting a consumable electrode to a printing position, the method comprising the steps of:

(a) positioning an electrode within a housing for sliding motion,
(b) clamping said electrode to prevent sliding thereof,
(c) biasing said electrode to slide,
(d) translating said housing from the beginning of a print line to the end of a print line,
(e) returning said housing to the beginning of a print line and reaching a release position, said release position being at the beginning of said print line,
(f) releasing said clamping at said release position to allow said electrode to slide,
(g) resuming said clamping and translating said housing from the beginning of a print line to the end of a print line.

* * * * *